US009147987B2

(12) United States Patent
Yao

(10) Patent No.: US 9,147,987 B2
(45) Date of Patent: Sep. 29, 2015

(54) ELECTRICAL CONNECTOR WITH REDUCED ELECTROMAGNETIC INTERFERENCE

(71) Applicant: LOTES CO., LTD, Keelung (TW)

(72) Inventor: Gui Lin Yao, Guangzhou (CN)

(73) Assignee: LOTES CO., LTD., Keelung (TW)

( * ) Notice: Subject to any disclaimer, the term of this patent is extended or adjusted under 35 U.S.C. 154(b) by 12 days.

(21) Appl. No.: 14/251,341

(22) Filed: Apr. 11, 2014

(65) Prior Publication Data

US 2015/0200510 A1 Jul. 16, 2015

(30) Foreign Application Priority Data

Jan. 10, 2014 (CN) ..... 2014 2 0013046 U

(51) Int. Cl.

| | |
|---|---|
| ***H01R 13/60*** | (2006.01) |
| ***H01R 13/66*** | (2006.01) |
| ***H01R 27/02*** | (2006.01) |
| ***H01R 13/6463*** | (2011.01) |
| ***H01R 24/64*** | (2011.01) |

(52) U.S. Cl.

CPC ..... *H01R 27/02* (2013.01); *H01R 13/6463* (2013.01); *H01R 24/64* (2013.01)

(58) Field of Classification Search

CPC ..... H01R 27/02; H01R 24/64; H01R 13/6463
USPC ..... 439/638, 660, 79, 541.5, 941
See application file for complete search history.

(56) References Cited

U.S. PATENT DOCUMENTS 8,109,795 B2 * 2/2012 Lin et al. ..... 439/660

* cited by examiner

*Primary Examiner* — Javaid Nasri
(74) *Attorney, Agent, or Firm* — Locke Lord LLP; Tim Tingkang Xia, Esq.

(57) ABSTRACT

An electrical connector includes an insulating body, and a first and second terminal groups located in the insulating body. The second terminal group is located below the first terminal group. The first terminal group has a first grounding terminal, and two pairs of first differential signal terminals located at two sides. The second terminal group has a pair of second differential signal terminals, a second grounding terminal and a power supply terminal located at two sides. The first differential signal terminal, the first and second grounding terminals, and the power supply terminal have a first, third, fourth and fifth fixing portions fixed to the insulating body, and a first, third, fourth and fifth vertical portions bends downward and extends from the corresponding fixing portions. The first grounding terminal is wider than the second differential signal terminal. The fourth and fifth vertical portions are wider than the first vertical portion.

14 Claims, 7 Drawing Sheets

ELECTRICAL CONNECTOR WITH REDUCED ELECTROMAGNETIC INTERFERENCE

CROSS-REFERENCE TO RELATED APPLICATION

This non-provisional application claims priority under 35 U.S.C. §119(a) on Patent Application No. 201420013046.2 filed in P.R. China on Jan. 10, 2014, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and particularly to an electrical connector that can reduce electromagnetic interference.

BACKGROUND OF THE INVENTION

In a portable electronic product, and in particular, a notebook computer, product design thereof generally aims to achieve maximum functions by use of a minimum volume space.

Nowadays, electronic technologies develop rapidly, such that a computer is developed from a desktop computer into a notebook computer, which is small in volume and convenient for carrying. Notebook computers generally exist at each corner of the world. When a user performs data or signal transmission or connects to another peripheral device, the so-called peripheral device interface is required, and a universal serial bus (USB) is most widely used. The conventional USB 2.0 has technical problems such as insufficient transmission speed and insufficient driving and operating power. Thus, on the basis of the existing USB 2.0 connector, the industry adds a row of USB 3.0 terminal groups to solve the foregoing problems. However, when this type of connector works, and in particular, when the connector works at a high frequency, mutual crosstalk inevitably occurs between a USB 2.0 terminal and a USB 3.0 terminal, thereby affecting signal transmission quality.

When a notebook computer needs to have multiple socket electrical connectors with the same communication protocol standard, such as having two USB electrical connectors to simultaneously connecting two electronic products using the USB transmission standard, in order to reduce the volume occupied by the socket electrical connectors, a stacked socket electrical connector is generally adopted. Although this stacked socket electrical connector conforms to the requirement of the portable electronic product on reduction of the space occupancy rate, the distance between various transmission terminals are also reduced while reducing the space occupancy rate, inevitably resulting in increasing of mutual electromagnetic crosstalk between signal terminals, thereby causing high-frequency instability and transmission signal distortion.

Therefore, a heretofore unaddressed need exists in the art to address the aforementioned deficiencies and inadequacies.

SUMMARY OF THE INVENTION

In one aspect, the present invention is directed to an electrical connector that has small electromagnetic crosstalk, and is stable at a high frequency.

In one embodiment, the electrical connector includes an insulating body and a first terminal group and a second terminal group disposed in the insulating body. The second terminal group is located below the first terminal group. The first terminal group includes a first grounding terminal, and two pairs of first differential signal terminals respectively located at two sides of the first grounding terminal. The second terminal group includes a pair of second differential signal terminals, and a second grounding terminal and a power supply terminal respectively located at two sides of the second differential signal terminal pair. The width of the first grounding terminal is greater than the width of the second differential signal terminal. The first differential signal terminal has a first fixing portion fixed to the insulating body, and a first vertical portion bending downward and extending from a back end of the first fixing portion. The first grounding terminal, the second grounding terminal, and the power supply terminal respectively have a third fixing portion, a fourth fixing portion and a fifth fixing portion fixed to the insulating body, and a third vertical portion, a fourth vertical portion and a fifth vertical portion bend downward and extend from a back end of the third fixing portion, a back end of the fourth fixing portion, and a back end of the fifth fixing portion respectively. The fourth vertical portion and the fifth vertical portion are both wider than the first vertical portion.

In one embodiment, the first differential signal terminal further has a first contact portion extending forward from the first fixing portion, and a first connection portion connecting the first contact portion and the first fixing portion. The first vertical portion bends downward and extends from the back end of the first fixing portion. The first connection portions of each pair of first differential signal terminals deflect inward and are drawn closer to each other relative to the first contact portions.

In one embodiment, the second differential signal terminal has a second fixing portion fixed to the insulating body, a second contact portion extending forward from the second fixing portion, a second connection portion connecting the second contact portion and the second fixing portion, and a second vertical portion bending downward and extending from a back end of the second fixing portion. The second connection portions of each pair of second differential signal terminals deflect inward and are drawn closer to each other relative to the first contact portions.

In one embodiment, the first fixing portion is connected to the first vertical portion through a first bending portion, and the first bending portion and the first fixing portion are wider than the first connection portion and the first vertical portion.

In one embodiment, the first vertical portion extends downward to form a first welding portion, and each pair of first vertical portions deflect mutually and are drawn closer to each other relative to the first welding portions and the first contact portions.

In one embodiment, each pair of second vertical portions deflect mutually and are drawn closer to each other relative to the second contact portions and the second fixing portions.

In another aspect, the present invention is directed to a stacked electrical connector, used for electrically connecting to a circuit board. In one embodiment, the stacked electrical connector includes an insulating housing internally provided with a first accommodating cavity, and a first connector accommodated in the first accommodating cavity. The first connector includes a first insulating body, and a first terminal group and a second terminal group respectively assembled in the first insulating body. The second terminal group is located below the first terminal group. The first terminal group includes a first grounding terminal, and two pairs of first differential signal terminals respectively located at two sides of the first grounding terminal. The second terminal group includes a pair of second differential signal terminals, and a second grounding terminal and a power supply terminal respectively located at two sides of the second differential signal terminal pair. The width of the first grounding terminal is greater than the width of the second differential signal terminal. The first differential signal terminal has a first vertical portion perpendicular to the circuit board. The second grounding terminal and the power supply terminal respectively have a fourth vertical portion and a fifth vertical portion perpendicular to the circuit board. The fourth vertical portion and the fifth vertical portion are both wider than the first vertical portion.

In one embodiment, the insulating housing further has a second accommodating cavity located below the first accommodating cavity. A second connector is accommodated in the second accommodating cavity. The first accommodating cavity runs through the insulating housing from front to back. A back end of the second accommodating cavity is provided with a vertical retaining wall. The first connector is assembled into the first accommodating cavity from a back end of the insulating housing, and the second connector is assembled into the second accommodating cavity from a front end of the insulating housing.

In one embodiment, the second connector includes a second insulating body. A third terminal group is accommodated in the second insulating body. The third terminal group includes multiple third terminals. The third terminal has a sixth vertical portion perpendicular to the circuit board. The sixth vertical portion bends horizontally and extends to form a horizontal segment. The horizontal segment bends downward and extends to form a seventh vertical portion. The seventh vertical portion extends downward to form a sixth welding portion welded onto the circuit board. The sixth vertical portion, the horizontal segment and the seventh vertical portion are all wider than the sixth welding portion. The total length in a vertical direction reaches 4.7±2 millimeter (mm).

In one embodiment, the second differential signal terminal has a second vertical portion perpendicular to the circuit board, and the first grounding terminal has a third vertical portion perpendicular to the circuit board. The back end of the insulating housing is provided with a spacer accommodating the first vertical portion, the second vertical portion, the third vertical portion, the fourth vertical portion and the fifth vertical portion. A metal housing covers the insulating housing. A metal sheet is located between the first connector and the second connector, and at least one part of the metal sheet covers the spacer and is electrically connected to the metal housing.

In one embodiment, the first differential signal terminal has a first fixing portion fixed to the insulating body. A first contact portion extends forward from the first fixing portion. A first connection portion connects the first contact portion and the first fixing portion. The first vertical portion bends downward and extends from a back end of the first fixing portion, and the first connection portions of each pair of first differential signal terminals deflect inward and are drawn closer relative to the first contact portions.

In one embodiment, the second differential signal terminal has a second fixing portion fixed to the insulating body. A second contact portion extends forward from the second fixing portion. A second connection portion connects to the second contact portion and the second fixing portion. The second vertical portion bends downward and extends from a back end of the second fixing portion, and the second connection portions of each pair of second differential signal terminals deflect inward and are drawn closer relative to the first contact portions.

In one embodiment, the first vertical portion extends downward to form a first welding portion, and each pair of first vertical portions deflect mutually and are drawn closer relative to the first welding portions and the first contact portions.

In one embodiment, each pair of second vertical portions deflect mutually and are drawn closer relative to the second contact portions and the second fixing portions.

Compared with the related art, certain embodiments of the present invention have the following beneficial advantages.

1. The first connection portions of each pair of first differential signal terminals deflect inward and are drawn closer relative to the first contact portions, each pair of first vertical portions deflect mutually and are drawn closer relative to the first welding portions and the first contact portions, the second connection portions of the second differential signal terminals deflect inward and are drawn closer relative to the second contact portions and the second fixing portions, and the second vertical portions deflect mutually and are drawn closer relative to the second contact portions and the second fixing portions, so as to not only enhance signal strength between each pair of first differential signal terminals and between each pair of second differential signal terminals, but also widen the interval between the first differential signal terminal and the second differential signal terminal from an oblique direction, and reduce capacitive coupling between the first differential signal terminal and the second differential signal terminal, thereby reducing mutual electromagnetic interference between the first differential signal terminal and the second differential signal terminal.

2. The width of the first grounding terminal is greater than the width of the second differential signal terminal on the whole, and the width of the fourth vertical portion and the width of the fifth vertical portion are both greater than the width of the first vertical portion, so as to reduce inductive coupling between first differential signal terminals located at two sides of the first grounding terminal, and reduce inductive coupling between the second differential signal terminals located between the second grounding terminal and the power supply terminal, thereby reducing electromagnetic interference between the first differential signal terminals and electromagnetic interference between the second differential signal terminals.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
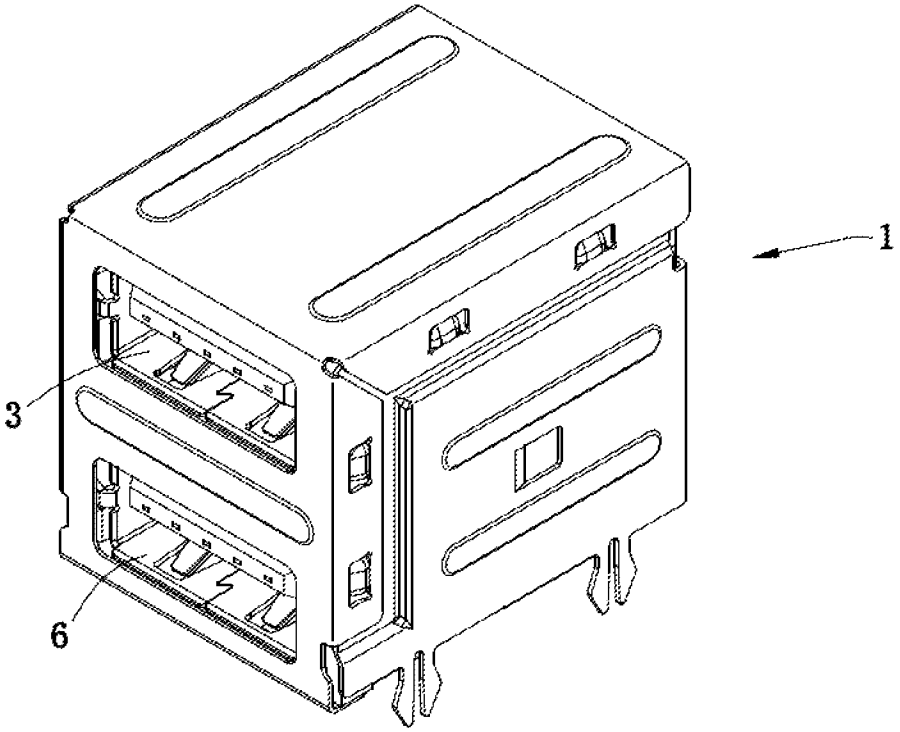
FIG. 1 is a three-dimensional view of a second embodiment of an electrical connector according to the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

Figure 2:
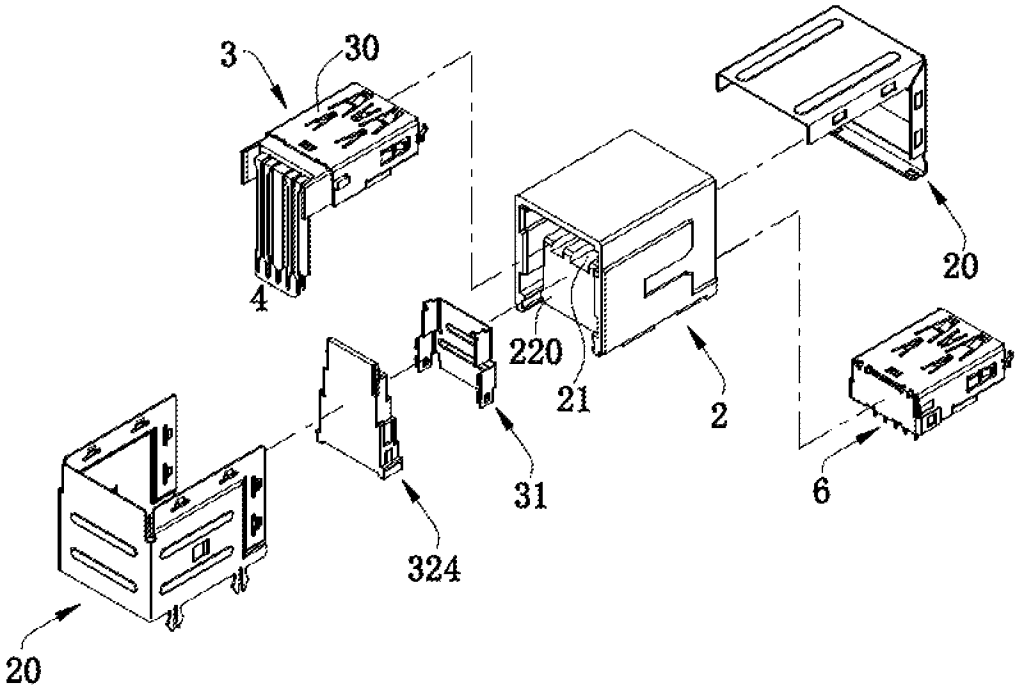
FIG. 2 is an exploded view of the second embodiment of the electrical connector according to the present invention.
Figure 3:
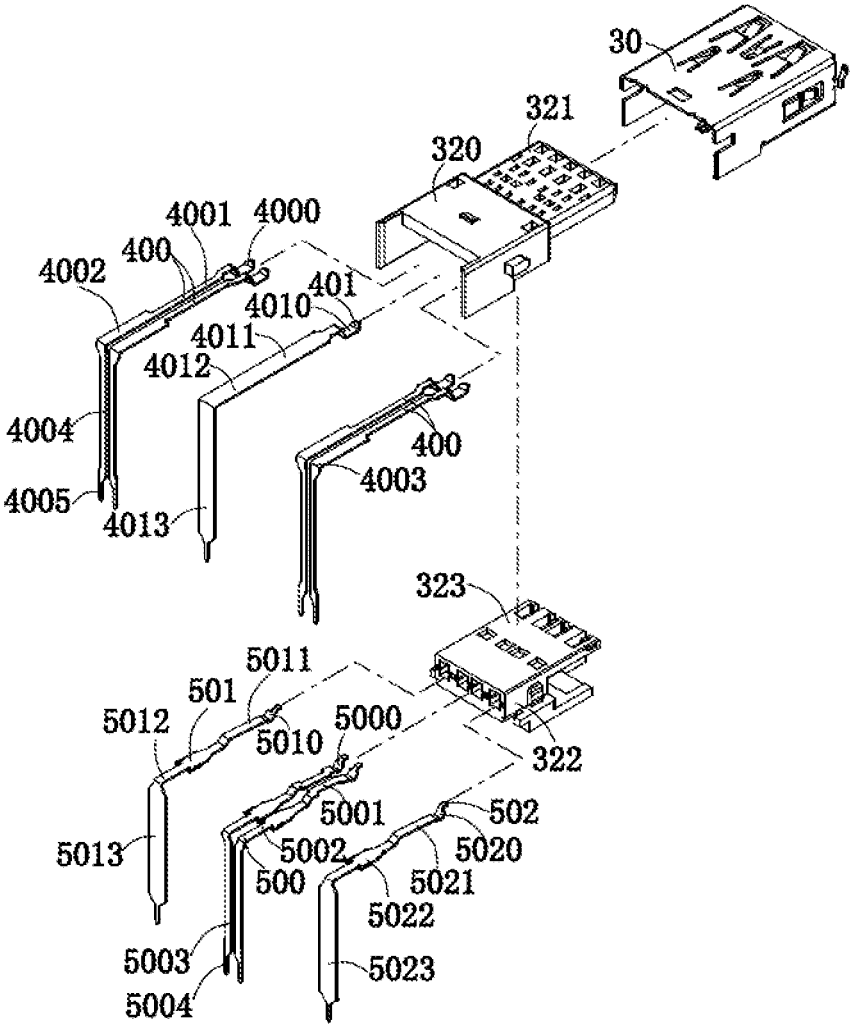
FIG. 3 is an exploded view of a first embodiment of the electrical connector according to the present invention.
Figure 5:
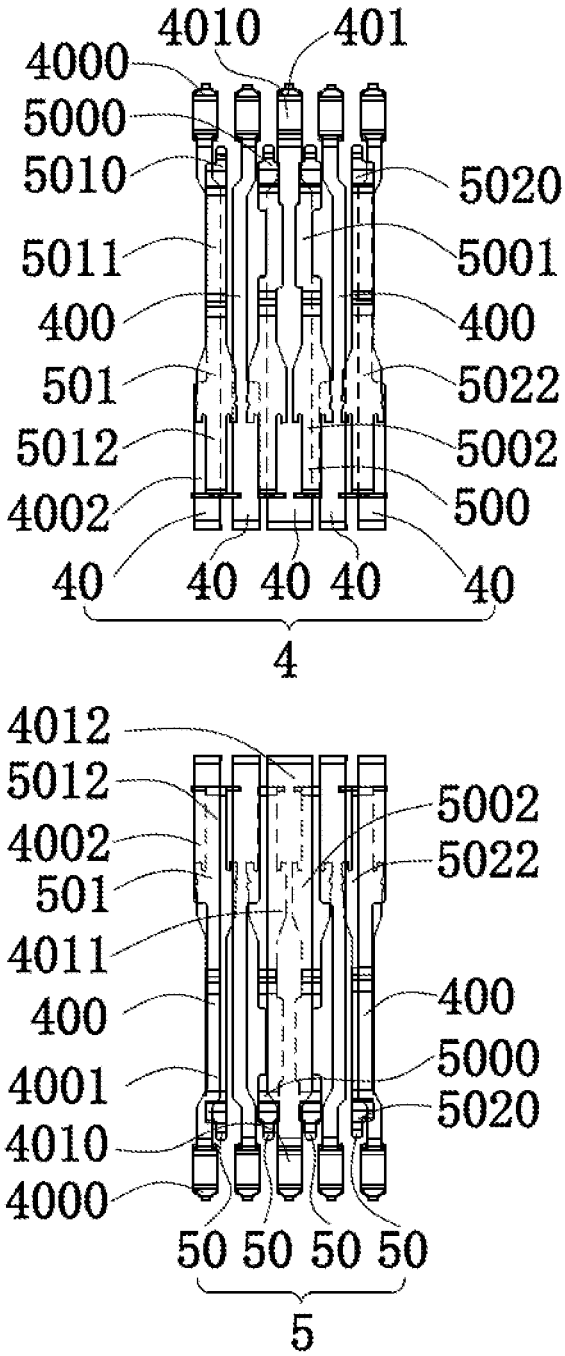
FIG. 5 is a top view and a bottom view of a terminal group of the first embodiment of the electrical connector according to the present invention.

As shown in FIGS. 2, 3 and 5, in a first embodiment, an electrical connector of the present invention includes an insulating body, and a first terminal group 4 and a second terminal group 5 accommodated in the insulating body.

As shown in FIG. 3, the insulating body includes a base 320, a first tongue 321 extending forward from the base 320, a seat 322 located below the first tongue 321 and the base 320, a second tongue 323 extending forward from the seat 322, and a spacer 324 located behind the base 320. A lower side of a front end of the first tongue 321 is provided with multiple first receiving slots (not shown). The seat 322 is provided with multiple second receiving slots (not shown). A lower side of the second tongue 323 is provided with multiple third receiving slots (not shown). The spacer 324 has a row of fourth receiving slots (not shown), and a row of fifth receiving slots (not shown) located behind the fourth receiving slots (not shown).

As shown in FIGS. 2, 3 and 5, the first terminal group 4 is formed by five first terminals 40 with an equal length. The first terminals 40 conform to the USB 3.0 communication protocol, and include a first grounding terminal 401 and two pairs of first differential signal terminals 400 respectively located at two sides of the first grounding terminal 401. The first differential signal terminal 400 has a first contact portion 4000, a first connection portion 4001, a first fixing portion 4002, and a first vertical portion 4004. The first fixing portion 4002 is embedded through injection molding in the base 320. The first contact portion 4000 extends forward from the first fixing portion 4002 and is located in and exposed from the first receiving slot (not shown). The first connection portion 4001 connects the first fixing portion 4002 and the first contact portion 4000, and is embedded through injection molding in the first tongue 321. The first vertical portion 4004 bends downward and extends from the back end of the first fixing portion 4002, and is received in the fifth receiving slot (not shown). The first fixing portion 4002 is connected to the first vertical portion 4004 through a bending portion 4003, and the width of the first fixing portion 4002 and the bending portion 4003 is greater than that of the first connection portion 4001 and the first vertical portion 4004, so as to reduce inductive coupling generated by each pair of first differential signal terminals 400 due to an excessively small interval, thereby reducing electromagnetic interference between the first differential signal terminals 400. The first connection portions 4001 of each pair of first differential signal terminals 400 deflect inward and are drawn closer to each other relative to the first contact portions 4000, so that the interval between part of the first connection portions 4001 is less than the interval between the first contact portions 4000, and therefore when a high-speed signal is transmitted, signals between each pair of first differential signal terminals 400 are mutually enhanced, thereby achieving the objective of enhancing the capability of anti-electromagnetic interference. The first vertical portion 4004 extends downward to form a first welding portion 4005. Each pair of first vertical portions 4004 deflect mutually and are drawn closer to each other relative to the first welding portions 4005 and the first contact portions 4000, so that the interval between the first vertical portions 4004 is less than the interval between the first welding portions 4005 and the interval between the first bending portions 4003, so as to enhance signal strength between the first vertical portions 4004. The first grounding terminal 401 has a third fixing portion 4012 embedded through injection molding in the base 320. A third contact portion 4010 extends forward from the third fixing portion 4012, and is located in and exposed from the first receiving slot (not shown). A third connection portion 4011 connects the third fixing portion 4012 and the third contact portion 4010. The third connection portion 4011 is embedded through injection molding in the first tongue 321. A third vertical portion 4013 bends downward and extends from the back end of the third fixing portion 4012, and is received in the fifth receiving slot (not shown).

As shown in FIGS. 2, 3 and 5, the second terminal group 5 is located below the first terminal group 4, and includes four second terminals 50 with an equal length. The second terminals 50 conform to the USB 2.0 communication protocol, and include a pair of second differential signal terminals 500, and a second grounding terminal 501 and a power supply terminal 502 respectively located at two sides of the pair of second differential signal terminals 500. The second differential signal terminal 500 has a second fixing portion 5002 inserted into the second receiving slot (not shown). A second contact portion 5000 extends forward from the second fixing portion 5002, and is located in and exposed from the third receiving slot (not shown). A second connection portion 5001 connects the second fixing portion 5002 and the second contact portion 5000, and is received in the third receiving slot (not shown). A second vertical portion 5003 bends downward and extends from the back end of the second fixing portion 5002, and is received in the fourth receiving slot (not shown). The second connection portions 5001 of the second differential signal terminals 500 deflect inward, and are drawn closer to each other relative to the second contact portions 5000 and the second fixing portions 5002, so that the interval between part of the second connection portions 5001 is less than the interval between the second contact portions 5000 and the interval between the second fixing portions 5002, and therefore when a high-speed signal is transmitted, signals between the second differential signal terminals 500 are mutually enhanced, thereby achieving the objective of enhancing the capability of anti-electromagnetic interference. The second vertical portion 5003 extends downward to form a second welding portion 5004. The second vertical portions 5003 deflect mutually, and are drawn closer relative to the second contact portions 5000 and the second fixing portions 5002, so that the interval between the second vertical portions 5003 is less than the interval between the second contact portions 5000 and the interval between the second fixing portions 5002, so as to enhance signal strength between the second vertical portions 5003. The second grounding terminal 501 and the power supply terminal 502 respectively have a fourth fixing portion 5012 and a fifth fixing portion 5022 inserted into the second receiving slots (not shown). A fourth contact portion 5010 and a fifth contact portion 5020 respectively extend forward from the fourth fixing portion 5012 and the fifth fixing portion 5022, and are located in and exposed from the third receiving slots (not shown). A fourth connection portion 5011 connects the fourth fixing portion 5012 and the fourth contact portion 5010. A fifth connection portion 5021 connects the fourth fixing portion 5012 and the fifth contact portion 5020. The fourth connection portion 5011 and the fifth connection portion 5021 are both received in the third receiving slots (not shown). A fourth vertical portion 5013 and a fifth vertical portion 5023 respectively bend downward and extend from the back end of the fourth fixing portion 5012 and the back end of the fifth fixing portion 5022, and are received in the fourth receiving slots (not shown).

As shown in FIG. 3 and FIG. 5, the first connection portions 4001 of each pair of first differential signal terminals 400 deflect inward and was drawn closer to each other relative to the first contact portions 4000, so that the interval between part of the first connection portions 4001 is less than the interval between the first contact portions 4000. Each pair of first vertical portions 4004 deflect mutually and are drawn closer to each other relative to the first welding portions 4005 and the first contact portions 4000, so that the interval between the first vertical portions 4004 is less than the interval between the first welding portions 4005 and the interval between the first bending portions 4003, so as to enhance signal strength between the first vertical portions 4004. The second connection portions 5001 of the second differential signal terminals 500 deflect inward and are drawn closer to each other relative to the second contact portions 5000 and the second fixing portions 5002, so that the interval between part of the second connection portions 5001 is less than the interval between the second contact portions 5000 and the interval between the second fixing portions 5002. The second vertical portions 5003 deflect mutually and are drawn closer to each other relative to the second contact portions 5000 and the second fixing portions 5002, so that the interval between the second vertical portions 5003 is less than the interval between the second contact portions 5000 and the interval between the second fixing portions 5002, so as to enhance signal strength between the second vertical portions 5003. Moreover, the pair of second differential signal terminals 500 are located in the middle of the two pairs of first differential signal terminals 400, and such structure not only enhances signal strength between each pair of first differential signal terminals 400 and between each pair of second differential signal terminals 500, but also widens the interval between the first differential signal terminal 400 and the second differential signal terminal 500 from an oblique direction, and reduce capacitive coupling between the first differential signal terminal 400 and the second differential signal terminal 500, thereby reducing mutual electromagnetic interference between the first differential signal terminal 400 and the second differential signal terminal 500.

As shown in FIG. 3, the width of the first grounding terminal 401 is greater than the width of the second differential signal terminal 500 on the whole. In other embodiments, the width of the first grounding terminal 401 is equal to the sum of the interval between the second differential signal terminals 500 and the width of two second differential signal terminals 500, and the width of the fourth vertical portion 5013, and the width of the fifth vertical portion 5023 are both greater than the width of the first vertical portion 4004. In other embodiments, the width of the fourth vertical portion 5013, and the width of the fifth vertical portion 5023 may further be both equal to the sum of the interval between each pair of first vertical portions 4004 and the width of two first vertical portions 4004, so as to reduce inductive coupling between first differential signal terminals 400 located at two sides of the first grounding terminal 401, and to reduce inductive coupling between the second differential signal terminals 500 located between the second grounding terminal 501 and the power supply terminal 502, thereby reducing electromagnetic interference between the first differential signal terminals 400 and electromagnetic interference between the second differential signal terminals 500.

As shown in FIG. 2, the electrical connector of this embodiment further includes a metal shell 30 covering the insulating body.

During assembly, the first terminals 40 of the first terminal group 4 and the second terminals 50 of the second terminal group 5 are all in a straight strip shape and do not bend. The first terminals 40 are embedded through injection molding in the first tongue 321 and the first base 320, and the second terminals 50 are inserted into the second tongue 323 and the seat 322. Then, the first terminals 40 and the second terminals 50 are bent. The vertical portions thereof are correspondingly inserted into the fourth receiving slots (not shown) and the fifth receiving slots (not shown). Finally the metal shell 30 is used for covering the insulating body.

As shown in FIGS. 1 to 6, in a second embodiment, the electrical connector of the present invention is a stacked electrical connector 1 for electrically connecting to a circuit board, and providing connections for two electronic products using the USB transmission standard at the same time. The stacked electrical connector includes an insulating housing 2, a first connector 3, and a second connector 6.

Figure 7:
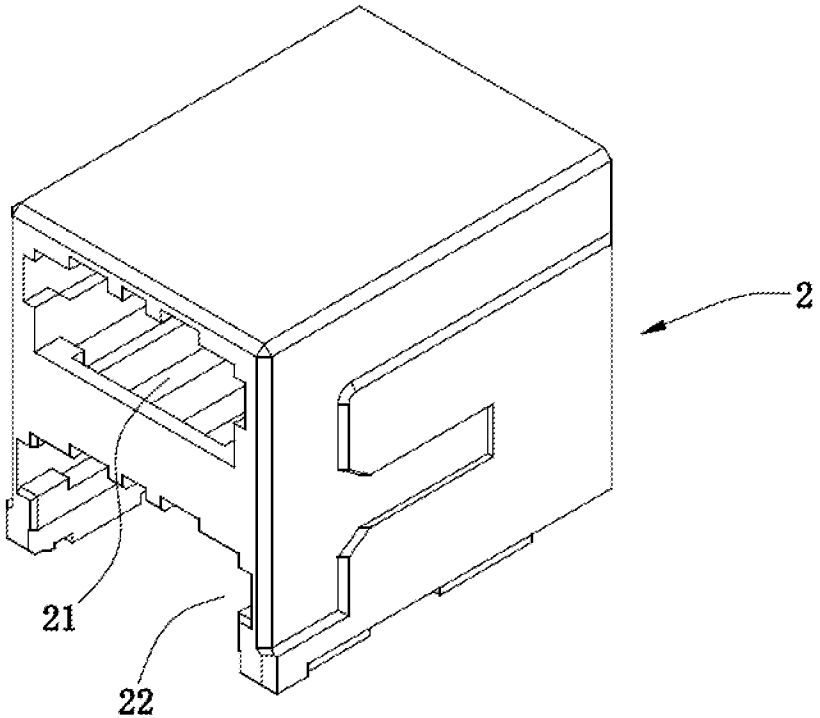
FIG. 7 is a three-dimensional view of an insulating housing of the second embodiment according to the present invention.

As shown in FIG. 2 and FIG. 7, the insulating housing 2 is internally provided with a first accommodating cavity 21 through the insulating housing 2 from front to back, a second accommodating cavity 22 is located below the first accommodating cavity 21, the back end of the second accommodating cavity 22 is provided with a vertical retaining wall 220, and a metal housing 20 covers the insulating housing 2.

As shown in FIG. 2 and FIG. 7, the first connector 3 is the same as the electrical connector in the first embodiment, and is assembled into the first accommodating cavity 21 from the back end of the insulating housing 2. The second connector 6 is assembled into the second accommodating cavity 22 from the front end of the insulating housing 2. A metal sheet 31 playing a role of shielding is located between the first connector 3 and the second connector 6. At least one part of the metal sheet 31 covers the spacer 324. The metal sheet 31 is electrically connected to the metal housing 20. The metal sheet 31 can reduce mutual electromagnetic interference between the first connector 3 and the second connector 6, thereby ensuring high-frequency stability of the two connectors.

Figure 4:
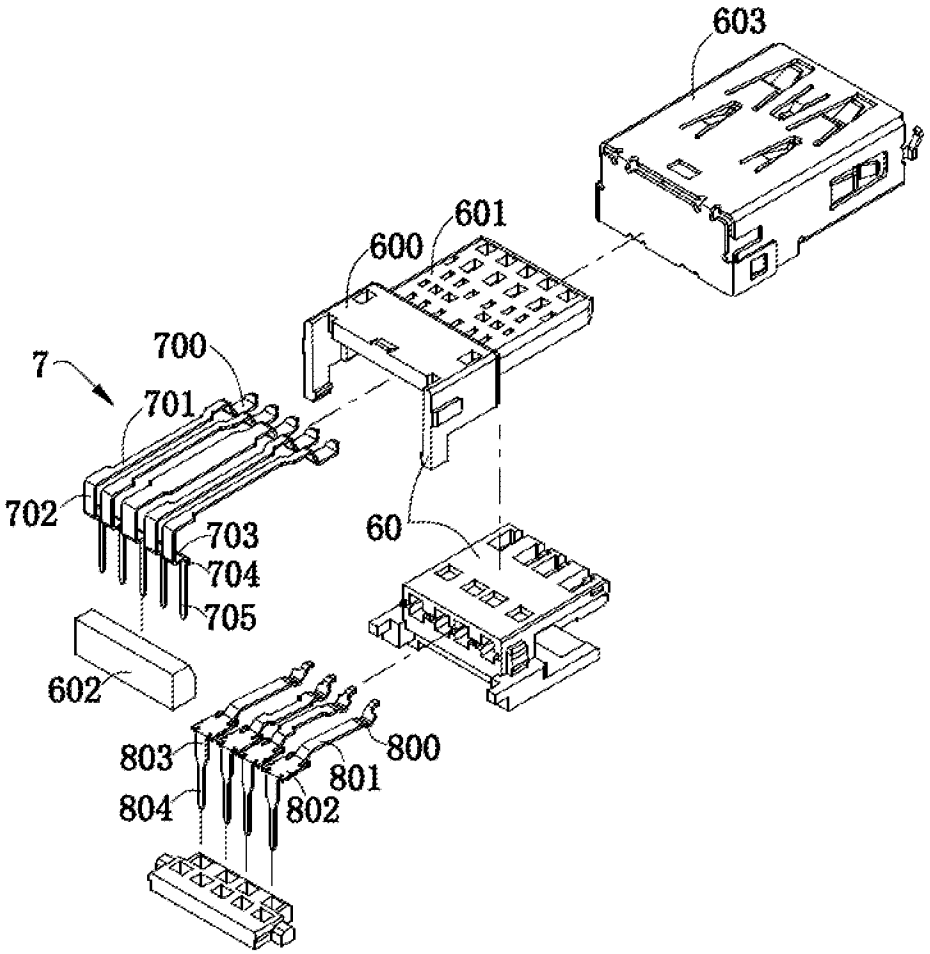
FIG. 4 is an exploded view of a second connector in the second embodiment of the electrical connector according to the present invention.

As shown in FIG. 4, the second connector 6 includes a second insulating body 60. A third terminal group 7 and a fourth terminal group 8 are respectively accommodated in the second insulating body 60. A second metal shell 603 covers the second insulating body 60.

As shown in FIG. 4, the second insulating body 60 includes a second base 600. Multiple sixth receiving slots (not shown) are disposed on the second base 600, and used for accommodating the fourth terminal group 8. A third tongue 601 extends forward from the second base 600. An insulating block 602 is located behind the second base 600. The insulating block 602 and the second base 600 are disposed in a two-piece manner.

As shown in FIG. 4, the third terminal group 7 includes multiple third terminals (not labeled). Each of the third terminals transmits a USB 3.0 signal, and has a sixth fixing portion 701 embedded through injection molding in the third tongue 601, and a sixth contact portion 700 bending downward and extending forward from the sixth fixing portion 701 and exposed at the lower side of the third tongue 601. A sixth vertical portion 702 bends backward and extends downward from the sixth fixing portion 701. The sixth vertical portion 702 bends forward and horizontally, and extends to form a horizontal segment 703. The horizontal segment 703 bends downward and extends form a seventh vertical portion 704. The seventh vertical portion 704 extends downward to form a sixth welding portion 705 for being welded to the circuit board. The sixth vertical portion 702, the horizontal segment 703, and the seventh vertical portion 704 are all wider than the sixth welding portion 705, and the total length in a vertical direction reaches 4.7±2 mm. Moreover, the width of the sixth fixing portion 701, the width of the sixth vertical portion 702, the width of the horizontal segment 703 and the width of the seventh vertical portion 704 are greater than the width of the sixth contact portion 700 and the width of the sixth welding portion 705. Part of the sixth vertical portion 702, the horizontal segment 703 and the seventh vertical portion 704 are accommodated in the insulating block 602.

Figure 6:
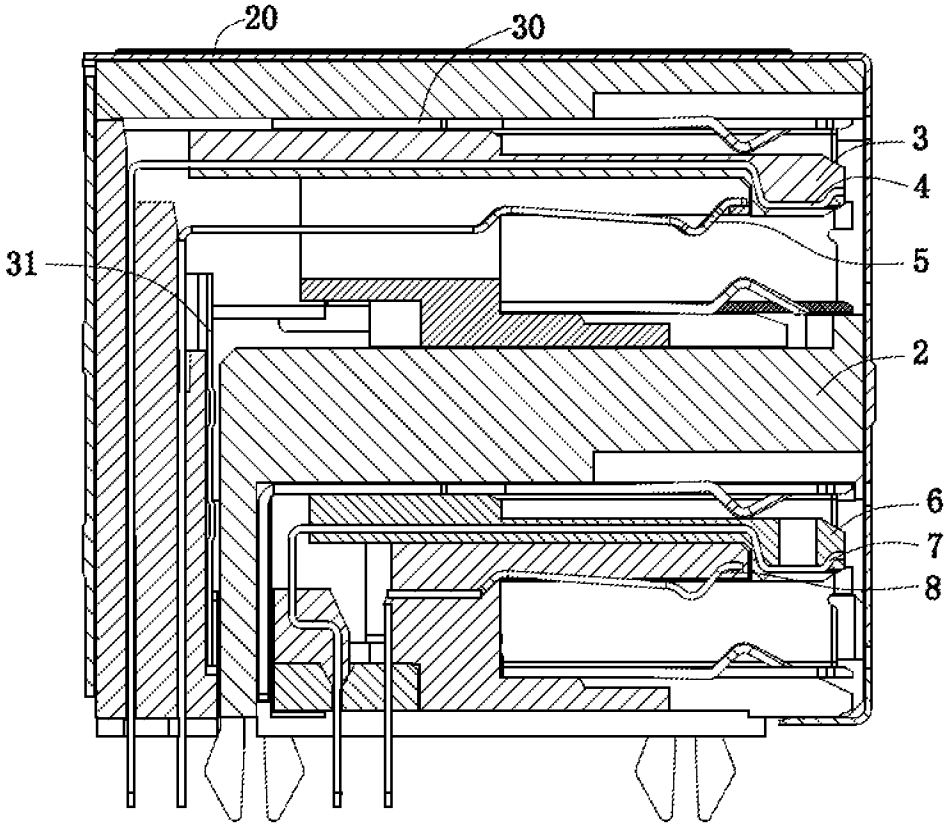
FIG. 6 is a sectional view of the second embodiment according to the present invention.

As shown in FIG. 4 and FIG. 6, the fourth terminal group 8 is located below the third terminal group 7, and includes multiple fourth terminals (not labeled) transmitting USB 2.0 signals. Each of the fourth terminals (not labeled) has a seventh fixing portion 802 fixed into the receiving slot. An elastic arm 801 bends upward and extends from the seventh fixing portion 802. That is to say, the seventh fixing portion 802 bends downward and extends. A seventh contact portion 800 extends forward from the elastic arm 801 and is exposed at the lower side of the third tongue 601. An eighth vertical portion 803 bends downward and extends from the seventh fixing portion 802. A seventh welding portion 804 is formed by extending downward from the eighth vertical portion 803.

As shown in FIG. 4 and FIG. 6, the sixth vertical portion 702 is behind the eighth vertical portion 803, and the sixth vertical portion 702 bends backward in a front to back direction, so that without increase of the height, the distance between the sixth vertical portion 702 and the eighth vertical portion 803 is widened, mutual electromagnetic interference between the third terminal group 7 and the fourth terminal group 8 is reduced, and the miniature development trend is facilitated.

During assembly, as shown in FIGS. 2-4, the third terminals of the third terminal group 7 and the fourth terminals of the fourth terminal group 8 are all in a straight strip shape and do not bend. The third terminals are embedded through injection molding in the third tongue 601 and the second base 600. The fourth terminals are inserted into the second base 600. Then, the third terminals and the fourth terminals are bent. The sixth vertical portion 702 and the seventh vertical portion 704 are embedded through injection molding in the insulating block 602. Finally, the second metal housing 603 is used for covering the insulating body. After that, the first connector 3 is assembled into the first accommodating cavity 21 from the back end of the insulating housing 2, and the second connector 6 is assembled into the second accommodating cavity 22 from the front end of the insulating housing 2.

In summary, the electrical connector according to certain embodiments of the present invention, among other things, has the following beneficial advantages.

1. The first connection portions 4001 of each pair of first differential signal terminals 400 deflect inward and are drawn closer relative to the first contact portions 4000, so that the interval between part of the first connection portions 4001 is less than the interval between the first contact portions 4000. Each pair of first vertical portions 4004 deflect mutually and are drawn closer to each other relative to the first welding portions 4005 and the first contact portions 4000, so that the interval between the first vertical portions 4004 is less than the interval between the first welding portions 4005 and the interval between the first bending portions 4003, so as to enhance signal strength between the first vertical portions 4004. The second connection portions 5001 of the second differential signal terminals 500 deflect inward and are drawn closer to each other relative to the second contact portions 5000 and the second fixing portions 5002, so that the interval between part of the second connection portions 5001 is less than the interval between the second contact portions 5000 and the interval between the second fixing portions 5002. The second vertical portions 5003 deflect mutually and are drawn closer to each other relative to the second contact portions 5000 and the second fixing portions 5002, so that the interval between the second vertical portions 5003 is less than the interval between the second contact portions 5000 and the interval between the second fixing portions 5002, so as to enhance signal strength between the second vertical portions 5003. Moreover, a pair of second differential signal terminals 500 are located in the middle of the two pairs of first differential signal terminals 400, and such structure not only enhances signal strength between each pair of first differential signal terminals 400 and between each pair of second differential signal terminals 500, but also widens the interval between the first differential signal terminal 400 and the second differential signal terminal 500 from an oblique direction, and reduce capacitive coupling between the first differential signal terminal 400 and the second differential signal terminal 500, thereby reducing mutual electromagnetic interference between the first differential signal terminal 400 and the second differential signal terminal 500.

2. The width of the first grounding terminal 401 is greater than the width of the second differential signal terminal 500 on the whole, and the width of the fourth vertical portion 5013, and the width of the fifth vertical portion 5023 are both greater than the width of the first vertical portion 4004, so as to reduce inductive coupling between first differential signal terminals 400 located at two sides of the first grounding terminal 401, and reduce inductive coupling between the second differential signal terminals 500 located between the second grounding terminal 501 and the power supply terminal 502, thereby reducing electromagnetic interference between the first differential signal terminals 400 and electromagnetic interference between the second differential signal terminals 500.

3. The total length of the sixth vertical portion 702 and the seventh vertical portion 704 in a vertical direction reaches 4.7±2 mm, the width of the sixth fixing portion 701, the width of the sixth vertical portion 702, the width of the horizontal segment 703 and the width of the seventh vertical portion 704 are greater than the width of the sixth contact portion 700 and the width of the sixth welding portion 705, so as not only to lengthen the vertical portion of the third terminal group, but also widen the vertical portion of the third terminal group, so that inductive coupling of the third terminal group 7 may be reduced, and electromagnetic interference may be reduced.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body; and a first terminal group and a second terminal group disposed in the insulating body, the second terminal group being located below the first terminal group, wherein the first terminal group comprises a first grounding terminal, and two pairs of first differential signal terminals respectively located at two sides of the first grounding terminal, the second terminal group comprises a pair of second differential signal terminals, and a second grounding terminal and a power supply terminal respectively located at two sides of the second differential signal terminal pair;

wherein the first differential signal terminal, the first grounding terminal, the second grounding terminal and the power supply terminal have a first fixing portion, a second fixing portion, a third fixing portion and a fourth fixing portion fixed to the insulating body respectively, and a first vertical portion, a second vertical portion, a third vertical portion, and a fourth vertical portion bending downward and extending from a back end of the first fixing portion, a back end of the second fixing portion, a back end of the third fixing portion, and a back end of the fourth fixing portion respectively; and wherein a width of the first grounding terminal is greater than a width of the second differential signal terminal, and a width of the third vertical portion and a width of the fourth vertical portion are greater than a width of the first vertical portion.

2. The electrical connector according to claim 1, wherein the first differential signal terminal further has a first contact portion extending forward from the first fixing portion, and a first connection portion connecting the first contact portion and the first fixing portion, the first vertical portion bends downward and extends from the back end of the first fixing portion, and the first connection portions of each pair of the first differential signal terminals deflect inward and are drawn closer to each other relative to the first contact portions.

3. The electrical connector according to claim 2, wherein the first fixing portion is connected to the first vertical portion through a first bending portion, and the first bending portion and the first fixing portion are wider than the first connection portion and the first vertical portion.

4. The electrical connector according to claim 2, wherein the first vertical portion extends downward to form a first welding portion, and each pair of the first vertical portions deflect mutually and are drawn closer to each other relative to the first welding portions and the first contact portions.

5. The electrical connector according to claim 1, wherein the second differential signal terminal comprises a fifth fixing portion fixed to the insulating body, a second contact portion extending forward from the fifth fixing portion, a second connection portion connecting the second contact portion and the fifth fixing portion, and a fifth vertical portion bending downward and extending from a back end of the fifth fixing portion, and wherein the second connection portions of each pair of the second differential signal terminals deflect inward and are drawn closer to each other relative to the first contact portions.

6. The electrical connector according to claim 5, wherein each pair of the fifth vertical portions deflect mutually and are drawn closer to each other relative to the second contact portions and the second fixing portions.

7. A stacked electrical connector for electrically connecting to a circuit board, comprising:

an insulating housing internally disposed with a first accommodating cavity; and a first connector accommodated in the first accommodating cavity, wherein the first connector comprises:

a first insulating body; and a first terminal group and a second terminal group disposed in the first insulating body, the second terminal group being located below the first terminal group, wherein the first terminal group comprises a first grounding terminal, and two pairs of first differential signal terminals respectively located at two sides of the first grounding terminal, the second terminal group comprises a pair of second differential signal terminals, and a second grounding terminal and a power supply terminal respectively located at two sides of the second differential signal terminal pair;

wherein the first differential signal terminal, the second grounding terminal and the power supply terminal respectively have a first vertical portion, a second vertical portion, and a third vertical portion perpendicular to the circuit board;

wherein a width of the first grounding terminal is greater than a width of the second differential signal terminal, and a width of the second vertical portion and a width of the third vertical portion are greater than a width of the first vertical portion.

8. The stacked electrical connector according to claim 7, wherein the insulating housing further comprises a second accommodating cavity located below the first accommodating cavity, a second connector is accommodated in the second accommodating cavity, the first accommodating cavity is disposed through the insulating housing from front to back, a back end of the second accommodating cavity has a vertical retaining wall, the first connector is assembled into the first accommodating cavity from a back end of the insulating housing, and the second connector is assembled into the second accommodating cavity from a front end of the insulating housing.

9. The stacked electrical connector according to claim 8, wherein the second connector comprises a second insulating body, and a third terminal group accommodated in the second insulating body; and wherein the third terminal group comprises multiple third terminals, each of the third terminals has a fourth vertical portion perpendicular to the circuit board, the fourth vertical portion bends horizontally and extends to form a horizontal segment, the horizontal segment bends downward and extends to form a fifth vertical portion, the fifth vertical portion extends downward to form a first welding portion for being welded to the circuit board, the fourth vertical portion, the horizontal segment and the fifth vertical portion are all wider than the first welding portion, and the total length in a vertical direction reaches 4.7±2 mm.

10. The stacked electrical connector according to claim 8, wherein the second differential signal terminal has a fourth vertical portion perpendicular to the circuit board, the first grounding terminal has a fifth vertical portion perpendicular to the circuit board, the back end of the insulating housing has a spacer accommodating the first vertical portion, the second vertical portion, the third vertical portion, the sixth vertical portion and the seventh vertical portion, a metal housing covers the insulating housing, a metal sheet is located between the first connector and the second connector, and at least one part of the metal sheet covers the spacer and is electrically connected to the metal housing.

11. The stacked electrical connector according to claim 7, wherein the first differential signal terminal further comprises a first fixing portion fixed to the insulating body, a first contact portion extending forward from the first fixing portion, and a first connection portion connecting the first contact portion and the first fixing portion, wherein the first vertical portion bends downward and extends from a back end of the first fixing portion, and the first connection portions of each pair of first differential signal terminals deflect inward and are drawn closer to each other relative to the first contact portions.

12. The stacked electrical connector according to claim 11, wherein the first vertical portion extends downward to form a second welding portion, and each pair of first vertical portions deflect mutually and are drawn closer to each other relative to the second welding portions and the first contact portions.

13. The stacked electrical connector according to claim 7, wherein the second differential signal terminal comprises a second fixing portion fixed to the insulating body, a second contact portion extending forward from the second fixing portion, and a second connection portion connecting the second contact portion and the second fixing portion, wherein the sixth vertical portion bends downward and extends from a back end of the second fixing portion, and the second connection portions of each pair of second differential signal terminals deflect inward and are drawn closer to each other relative to the first contact portions.

14. The stacked electrical connector according to claim 13, wherein each pair of sixth vertical portions deflect mutually and are drawn closer to each other relative to the second contact portions and the second fixing portions.

* * * * *